US005594961A

United States Patent [19]

Yokoi et al.

[11] Patent Number: 5,594,961

[45] Date of Patent: Jan. 21, 1997

[54] ADJUSTABLE HEIGHT BED

[75] Inventors: Shinji Yokoi; Shinji Michida, both of Okazaki; Yoshinori Mori, Chiryu; Tsuyoshi Nishidera, Anjo, all of Japan

[73] Assignee: Aisin Seiki Kabushiki Kaisha, Kariya, Japan

[21] Appl. No.: 276,802

[22] Filed: Jul. 18, 1994

[30] Foreign Application Priority Data

| | | | |
|---|---|---|---|
| Jul. 16, 1993 | [JP] | Japan | 5-177079 |
| Oct. 5, 1993 | [JP] | Japan | 5-249514 |
| Jan. 28, 1994 | [JP] | Japan | 6-008767 |

[51] Int. Cl.[6] ..... A47C 31/00; A61G 13/06

[52] U.S. Cl. ..... 5/11

[58] Field of Search ..... 5/11, 611, 310, 5/311, 312

[56] References Cited

U.S. PATENT DOCUMENTS

| | | | |
|---|---|---|---|
| 2,291,392 | 7/1942 | Krakauer | 5/21 |
| 4,344,195 | 8/1982 | Gustafson | 5/11 |
| 5,271,113 | 12/1993 | White | 5/11 |

FOREIGN PATENT DOCUMENTS

| | | | |
|---|---|---|---|
| 305434 | 5/1918 | Germany | 5/11 |
| 9207379 | 9/1992 | Germany . | |
| 5-176829 | 7/1993 | Japan . | |

*Primary Examiner*—Alexander Grosz
*Attorney, Agent, or Firm*—Oblon, Spivak, McClelland, Maier & Neustadt, P.C.

[57] ABSTRACT

A bed includes a bed body, ascending and descending means, and an auxiliary leg member. The bed body has a floor frame, and a main leg member fixed to the floor frame. The ascending and descending means has an ascending and descending link, and an extensible and retractable actuator for operating the ascending and descending link. The ascending and descending link holds the bed body with one of the opposite ends, and it holds the auxiliary leg member with the other one of the opposite ends. For instance, the ascending and descending link constitutes a parallel link, the floor frame constitutes one of the parallel elements of the parallel link, and the auxiliary leg member constitutes the other one of the parallel elements of the parallel link, thereby enabling the whole bed body including a mattress to ascend and descend.

5 Claims, 14 Drawing Sheets

ADJUSTABLE HEIGHT BED

BACKGROUND OF THE INVENTION

1. Field of the Invention

The present invention relates to a bed with which sleeping accommodations, such as hotels and the like, can be appropriately equipped.

2. Description of the Related Art

Bed-making required for service beds in sleeping accommodations, such as hotels and the like, is usually carried out by pushing a sheet under the rim of a mattress which is placed on a bed. However, since it is necessary for bed-making personnel to complete a large number of beds in a limited period of time, it is an extremely demanding job. In particular, since the bed-making personnel must bend the body forward in order to carry out the bed-making, many of them suffer from backaches. Accordingly, there arises a problem about which the accommodation industry is concerned.

In order to solve the aforementioned problem, it is possible to convert a continuously variable type ascending and descending mechanism for a medical bed (as set forth in Japanese Unexamined Patent Publication (KOKAI) No. 57-139,319) into a service bed. However, the ascending and descending mechanism is designed to adjust the bed height continuously, so that it takes a long time to move the bed from the descended position to the ascended position or vice versa. Accordingly, there still remains a drawback which inhibits the ascending and descending mechanism from being practically applied to service beds, because it is necessary to complete the bed-making of the service beds in a short period of time.

Hence, the assignee of the present invention applied for a Japanese Patent for a newly invented bed in Japanese Patent Application No. 3-347,028. The bed comprises a bed body provided with an extensible and retractable actuator which is capable of extending and retracting quickly by the action of a gas spring or the like. With the extensible and retractable actuator, an ascending and descending link comprising a parallel link or the like is operated so as to ascend an ascending and descending base, which is fixed to the ascending and descending link, from a descended position (i.e., an ordinary service position) to an ascended position and to hold the base there where bed-making personnel can carry out the bed-making with ease.

The bed according to the prior Japanese Patent Application, however, has the following drawback. Namely, the bed is designed to ascend and descend the ascending and descending base which is disposed on the top side of the bed body. Accordingly, when ascending the ascending and descending base, the bed body and the mattress are separated from each other so that bed-making personnel can scarcely determine the displacement of the mattress. As a result, when the ascending and descending base is descended and the mattress is returned back onto the bed body, bed-making personnel eventually determine the displacement of the mattress, and consequently he or she must carry out the bed-making again.

In addition, when the bed is placed near a wall, it is necessary for bed-making personnel to move the bed and provide a space between the bed and the wall for carrying out the job. In order to cope with the situation, it is possible to think of installing a caster to the bed body and thereby making the bed body movable. However, if it is done so, the bed is likely to move during the ordinary service and it is worse in terms of stability.

SUMMARY OF THE INVENTION

It is therefore an object of the present invention to provide engineering techniques which enable bed-making personnel not only to carry out the bed-making while standing by means of an ascending and descending mechanism with which a bed can be provided, but also to move a bed with ease but without deteriorating the stability of the bed during the ordinary service, and which enable bed-making personnel to easily find the displacements of the mattress.

A bed according to the present invention comprises:

a bed body including a floor frame, and a main leg member fixed to the floor frame;

ascending and descending means including an ascending and descending link, the ascending and descending link having opposite ends and holding the bed body with one of the opposite ends, and an extensible and retractable actuator for operating the ascending and descending link; and an auxiliary leg member held to the other one of the opposite ends of the ascending and descending link.

In a preferred form, the ascending and descending link constitutes a parallel link including a pair of parallel elements, the floor frame constitutes one of the parallel elements of the parallel link, and the auxiliary leg member constitutes the other one of the parallel elements of the parallel link.

In a further preferred form, the ascending and descending link further includes a pair of rotary elements connecting between the parallel elements of the parallel link and held rotatably therebetween, one of the rotary elements having upper and lower sides and a projection end disposed on the lower side, and a caster disposed on the projection end, the caster constituting a part of the auxiliary leg member and held rotatably about a supporting shaft.

In a further preferred form, the ascending and descending link further includes an auxiliary actuator disposed between the parallel elements of the parallel link, and capable of extending and retracting in the ascending and descending directions of the parallel link synchronously with the extending and retracting operations of the extensible and retractable actuator.

In a preferred form, the ascending and descending link further includes, a pair of rotary members having opposite ends, one of the rotary members held rotatably to the bed body at one of the opposite ends, the other one of the rotary members held reciprocally and rotatably to the bed body at one of the opposite ends, and a fulcrum member supporting one of the rotary members and the other one of the rotary members relatively rotatably at a middle of the rotary members.

In a further preferred form, the ascending and descending link is provided with the auxiliary leg member, one of the rotary members is held reciprocally and rotatably to the auxiliary leg member at the other one of the opposite ends, and the other one of the rotary members is held rotatably to the auxiliary leg member at the other one of the opposite ends.

In a further preferred form, the extensible and retractable actuator has opposite ends, it is swingably held to the bed body at one of the opposite ends, and it is held swingably to one of the rotary members at the other one of the opposite ends.

In a preferred form, the ascending and descending link further includes looking means for locking operations of the ascending and descending link, and lock releasing means for releasing operations of the locking means.

The operations of the present bed will be hereinafter described. In the present bed, when the bed body is ascended and descended, a mattress is ascended and descended together with the bed body. Accordingly, the bed body and the mattress are inseparable during the operation. As a result, it is possible for bed-making personnel to easily determine whether the mattress is displaced on the bed body or not.

In addition, in the present bed, when the parallel link further includes a pair of rotary elements connecting between the parallel elements of the parallel link and held rotatably therebetween, when one of the rotary elements has upper and lower sides and a projection end disposed on the lower side, and when a caster, constituting a part of the auxiliary leg member and held rotatably about a supporting shaft, is disposed on the projection end, it is possible for bed-making personnel to swing the present bed about an end side where the caster is held rotatably about a supporting shaft. Consequently, it is possible for him or her to move the present bed with a smaller working force than the working force required for moving a conventional bed as a whole.

In particular, it is preferred that the ascending and descending link and the extensible and retractable actuator be disposed with one on opposite sides of the center line of the present bed, and that the links and the actuators be operated simultaneously and at an identical speed. With these arrangements, the present bed can be inhibited from inclining during the ascending and descending operations, and the main leg member can be prohibited from grounding incompletely. All in all, the present bed can be enhanced in terms of the stability.

In addition, when the ascending and descending link is equipped with the locking means and the look releasing means, the extensible and retractable actuator can be inhibited from operating accidentally.

As has been described so far, in accordance with the present invention, when the bed body is ascended and descended, the mattress can be ascended and descended together with the bed body. As a result, it is possible for bed-making personnel to easily determine whether the mattress is displaced on the bed body or not. Thus, the present invention can eliminate the need for bed-making personnel to make the bed again. At the same time, it enables him or her to easily move the present bed to places where he or she can carry out the bed-making appropriately. Accordingly, the present invention can improve the bed-making in terms of the operability.

Further, in accordance with the present invention, the caster of the present bed can be taken out and taken in simultaneously with the ascending and descending operations of the bed body. Consequently, the present bed can be operated with ease and within a short period of operating time.

Furthermore, in accordance with the present invention, it is possible to position the caster, which is held rotatably about a supporting shaft, away from a floor when the bed body is descended. Accordingly, the present bed hardly moves when a person is sleeping in the present bed or when it is not subjected to the bed-making. Hence, the present bed is good in terms of the stability.

Moreover, in accordance with the present invention, the present bed can be provided with a pair of the extensible and retractable actuators, and a supporting member can be formed in a pair in an identical construction for supporting a pair of the actuators. Thus, it is possible to equally apply a load to the actuators because they are supported by the supporting member of the same construction. Consequently, it is possible to inhibit the present bed from inclining during the operations, and to prohibit the main leg member from grounding incompletely. As a result, it is possible to further enhance the stability of the present bed.

In addition, in accordance with the present invention, the ascending and descending link can be equipped with the locking means for locking the operations of the ascending and descending link when the bed body is descended, and the lock releasing means for intentionally releasing the operations of the locking means. With these arrangements, it is possible to enlarge the force required for the extensible and retractable actuator greater than the weight of the bed body. Accordingly, it is possible to further reduce the force required for bed-making personnel for ascending the bed body, and also to enhance the stability of the present bed when the bed body is put into the descended state.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENT

Having generally described the present invention, a further understanding can be obtained by reference to the specific preferred embodiment which is provided herein for purposes of illustration only and are not intended to limit the scope of the appended claims.

First Preferred Embodiment

Figure 2:
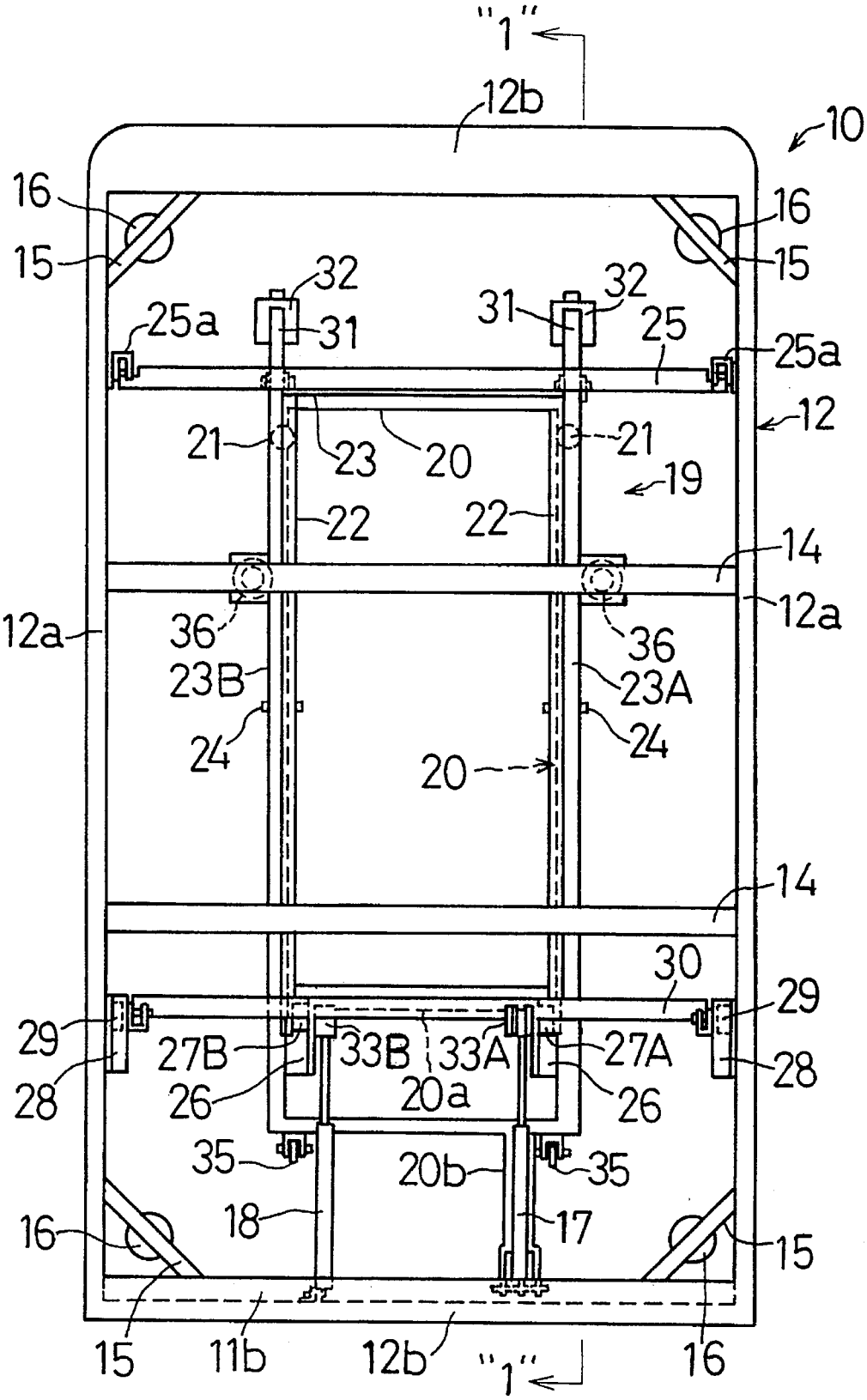
FIG. 2 is a plan view of the First Preferred Embodiment of the present bed.
Figure 3:
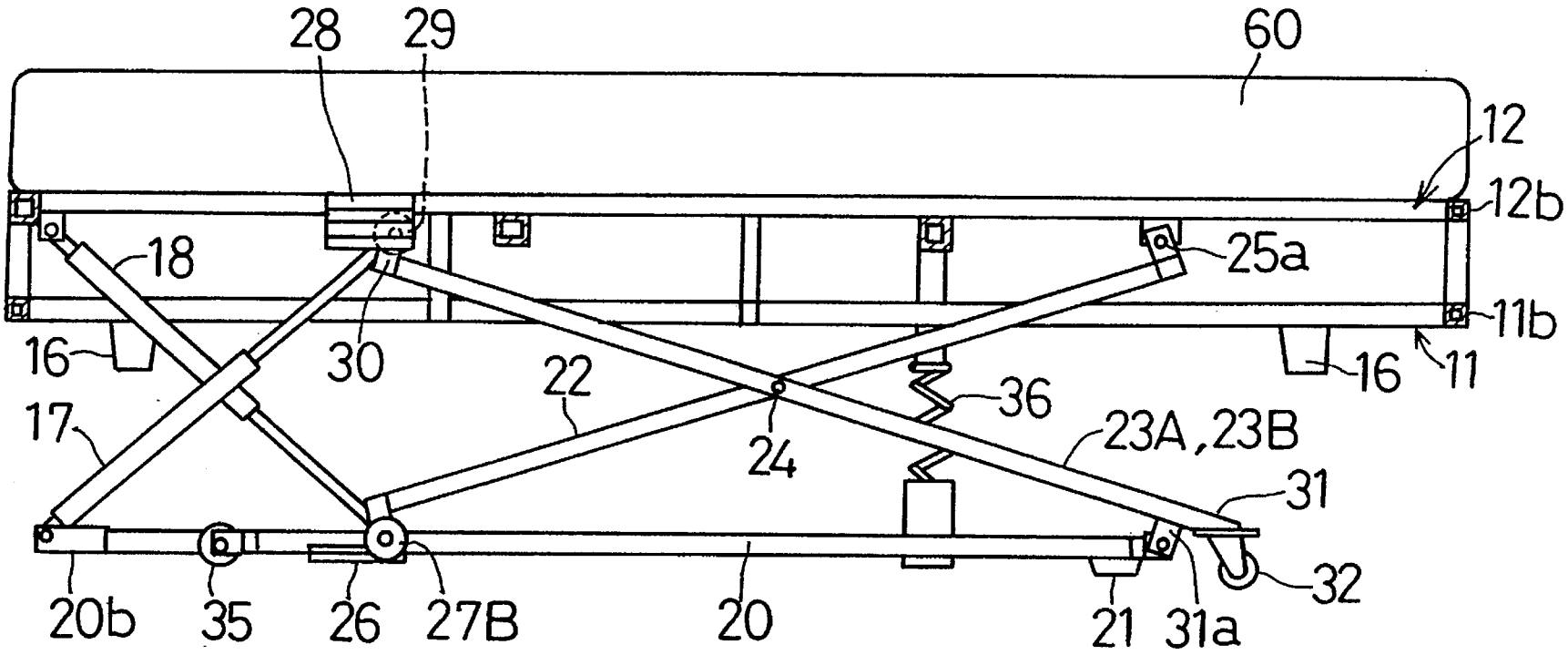
FIG. 3 is a cross-sectional view for illustrating the First Preferred Embodiment of the present bed in operation.

The First Preferred Embodiment of a bed according to the present invention will be hereinafter described with reference to FIGS. 1 through 3. A bed body 10 is comprised of a rectangle-shaped bottom frame 11, a floor frame 12 of the same shape, and a plurality of supporting pillars 13 disposed between the bottom frame 11 and the floor frame 12. As illustrated in FIG. 2, the floor frame 12 is comprised of floor-side longer frames 12*a*, 12*a* disposed in the longitudinal direction (hereinafter referred to as the "forward and rearward direction"), and floor-side shorter frames 12*b*, 12*b* disposed in the lateral direction perpendicularly with the floor-side longer frames 12*a*, 12*a*. Likewise, the bottom frame 11 is comprised of bottom-side longer frames 11*a*, 11*a*, and floor-side shorter frames 11*b*, 11*b*. The floor frame 12 is provided with a plurality of floor bars 14 connecting between the opposing floor-side longer frames 12*a*, 12*a*. Similarly, the bottom frame 11 is provided with a plurality of bottom bars (not shown) connecting between the opposing bottom-side longer frames 11*a*, 11*a*. Further, the bottom frame 11 is provided with four oblique bars 15 at the four corners where the bottom-side longer bar 11*a* and the bottom-side shorter bar 11*b* cross each other. The oblique bars 15 bridge between the bottom-side longer bar 11*a* and the bottom-side shorter bar 11*b*. Furthermore, each of the oblique bars 15 is equipped with a main leg 16.

The First Preferred Embodiment of the present bed is provided with ascending and descending means for ascending and descending a mattress 60 and the bed body 10 as a whole. As illustrated in FIG. 2, the ascending and descending means is comprised of two extensible and retractable actuators 17, 18, and an ascending and descending link 19 operated by the extensible and retractable actuators 17, 18. The extensible and retractable actuators 17, 18 are disposed, for example, on the rear side of the bed body 10, and they are put into a crossing relationship as illustrated in FIG. 1.

As can be appreciated from FIG. 2, the ascending and descending link 19 is comprised of a pair of parallel elements, and a pair of rotary elements which are disposed respectively on the left and right sides and which are put into a crossing relationship. In the First Preferred Embodiment, for instance, one of the parallel elements is the floor frame 12, and the other one of the parallel elements is a rectangle-shaped auxiliary leg member 20 having a laterally-traversing bar 20*a*. The auxiliary leg member 20 is equipped with a pair of legs 21, 21 which are disposed projectingly on the left and right forward-sides, respectively. The rotary elements are comprised of inner-side rotary members 22, 22 which are disposed respectively on the left and right inner-sides, and outer-side rotary members 23B, 23A which are disposed respectively on the left and right outer-sides. The inner-side rotary members 22, 22, and the outer-side rotary members 23B, 23A can be rotated about fulcrum members 24, 24.

Figure 1:
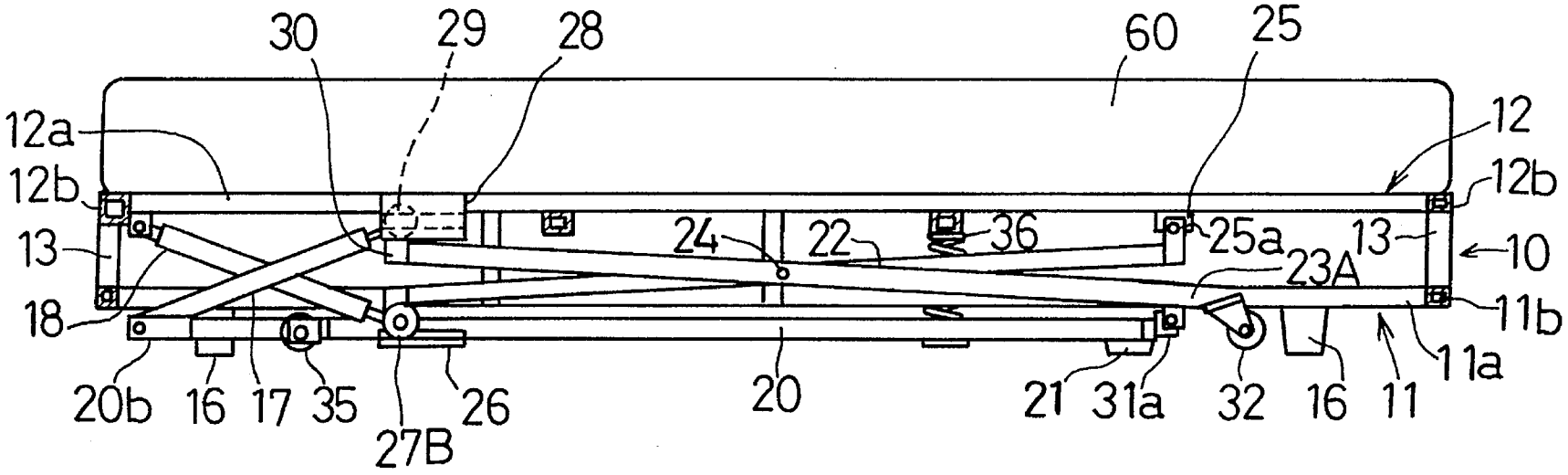
FIG. 1 is a cross-sectional view of a First Preferred Embodiment of a bed according to the present invention which is taken along the lines "1"—"1" of FIG. 2.

As can be understood from FIG. 1, at an upper end of the inner-side rotary members 22, 22, the inner-side rotary members 22, 22 are rotatably supported by an upper forward-side rotary bar 25 via fulcrum members 25*a*, 25*a*, respectively. As best shown in FIG. 2, the upper forward-side rotary bar 25 bridges between the floor-side longer frames 12*a*, 12*a*. As illustrated in FIG. 2, at a lower end of the inner-side rotary members 22, 22, the inner-side rotary members 22, 22 are rotatably supported by a rotary shaft of rollers 27A, 27B, respectively. As can be appreciated from FIG. 1, the rollers 27B, 27A can rotate respectively on inner-side rails 26, 26 which are installed on the auxiliary leg member 20.

As can be seen from FIG. 1, at an upper end of the outer-side rotary members 23A, 23B, the outer-side rotary members 23A, 23B are rotatably supported by rollers 29, 29, respectively, via an upper rearward-side rotary bar 30. As illustrated in FIG. 2, the rollers 29, 29 can rotate respectively on outer-side rails 28, 28 which are installed on the floor-side longer frames 12*a*, 12*a*. Turning now to FIG. 1, at a lower end of the outer-side rotary members 23A, 23B, the outer-side rotary members 23A, 23B are supported respectively by fulcrum members 31*a*, 31*a*, which are installed on the auxiliary leg member 20. As best shown in FIG. 2, projection ends 31, 31 are disposed on the fulcrum members 31*a*, 31*a* so as to further extend therefrom, and they are equipped with a caster 32 which is held rotatably about a supporting shaft.

As illustrated in FIG. 2, the extensible and retractable actuator 17 is supported rotatably by an extension member 20*b* of the auxiliary leg member 20 at the base end, and it is supported rotatably by the roller 27A via a fulcrum member 33A at the working end. The extensible and retractable actuator 18 is supported rotatably by the floor-side shorter frame 12*b* at the base end, and it is supported rotatably by the roller 27B via a fulcrum member 33B at the working end. Here, a gas spring having a free piston is used for the extensible and retractable actuators 17, 18. It is naturally possible to use a gas piston having a locking mechanism therefor.

Further, as best shown in FIG. 2, on the rear lower surface of the auxiliary leg member 20, there are installed a pair of casters 35, 35 which can be fixed to a supporting shaft.

Furthermore, as illustrated in FIGS. 1 and 2, between the floor bar 14 and the auxiliary leg member 20, there are disposed a pair of springs 36, 36 which help the extending and retracting operations of the extensible and retractable actuators 17, 18 at their start-up.

The operations of the First Preferred Embodiment of the present bed thus constructed will be hereinafter described. First of all, when the present bed is in the ordinary service position, the bed body 10 is placed at the lowermost position as illustrated in FIG. 1. At this moment, the extensible and retractable actuators 17, 18 are contracted by the gravity of the bed body 10.

When ascending the bed body 10, the bed body 10 is slightly pushed up manually. Thus, the extensible and retractable actuators 17, 18 are now subjected to the thus decreased external force, and accordingly they start extending. When the actuators 17, 18 start extending, the springs 36, 36 further reduce the external force applied to the actuators 17, 18, and consequently, due to their elastic force, the extending force of the actuators 17, 18 is increased. As a result, the rollers 27A, 27B and the rollers 29, 29 are rotated on the rails 26, 26 and on the rails 28, 28, respectively, in the right direction of FIG. 1. At the same time, the rotary members 22, 22, 23A, 23B of the ascending and descending link 19 rotate so as to increase the angles between them and the floor frame 12 and the angles between them and the auxiliary leg member 20 as illustrated in FIG. 3. Finally, the bed body 10 is ascended to an uppermost position which is determined by the extensible and retractable actuators 17, 18 and the springs 36, 36. When a gas piston having a looking mechanism is used for the actuators 17, 18, it is possible to selectively hold the bed body 10 at desired heights.

In the First Preferred Embodiment of the present bed, during the initial stage of ascending the bed body 10, the projection ends 31, 31 of the outer-side rotary members 23A, 23B respectively project to a position where they are below the auxiliary leg member 20. Accordingly, the casters 32, 32 held rotatably around a supporting shaft are grounded on the floor surface, respectively. In addition, during the initial stage, the rearward-side casters 35, 35 are originally grounded on the floor surface, respectively. As a result, the bed body 10 can be moved freely by means of the casters 32, 32 and the casters 35, 35. This movement is designed so as to swing the forward-side of the present bed. Accordingly, without pulling the present bed as a whole, bed-making personnel can move the present bed with ease by simply pulling the forward end of the present toward him- or herself.

When putting the bed body 10 back to the ordinary service position, it is necessary to simply press down the bed body 10.

In the First Preferred Embodiment of the present bed, since the bed body 10 is ascended and descended, the mattress 60 can be ascended and descended together with the bed body 10. Accordingly, the bed body 10 and the mattress 60 can be inseparable during the operations. As a result, bed-making personnel can easily determine whether the mattress 60 is displaced on the bed body 10 or not. Thus, it is not necessary for him or her to carry out the bed-making again.

Further, in accordance with the First Preferred Embodiment of the present bed, a bed-making personnel can move the present bed with ease to places where he or she can carry out the bed-making appropriately. Accordingly, the bed-making can be improved in terms of the operability. Furthermore, he or she can take out and take in the casters 32, 32 simultaneously with the ascending and descending operations of the bed body 10. Consequently, he or she can easily operate the present bed within a short period of operating time. Moreover, when the bed body 10 is fully descended, the casters 32, 32 held rotatably about a supporting shaft are positioned away from the floor surface. As a result, when a person is sleeping in the present bed or when bed-making personnel is not working on it, the present bed scarcely moves. Thus, the present bed produces a good stability.

Second Preferred Embodiment

Figure 4:
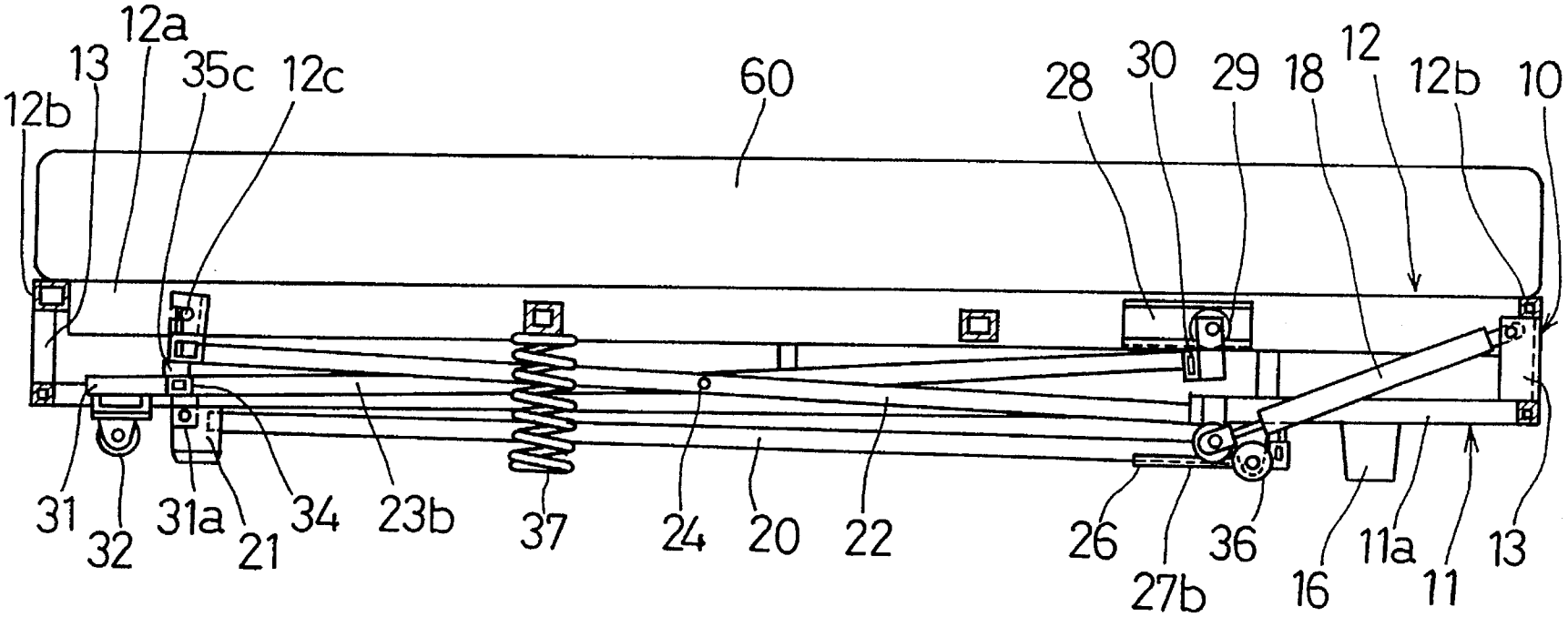
FIG. 4 is a cross-sectional view which is taken along the lines "4"—"4" of FIG. 5.
Figure 5:
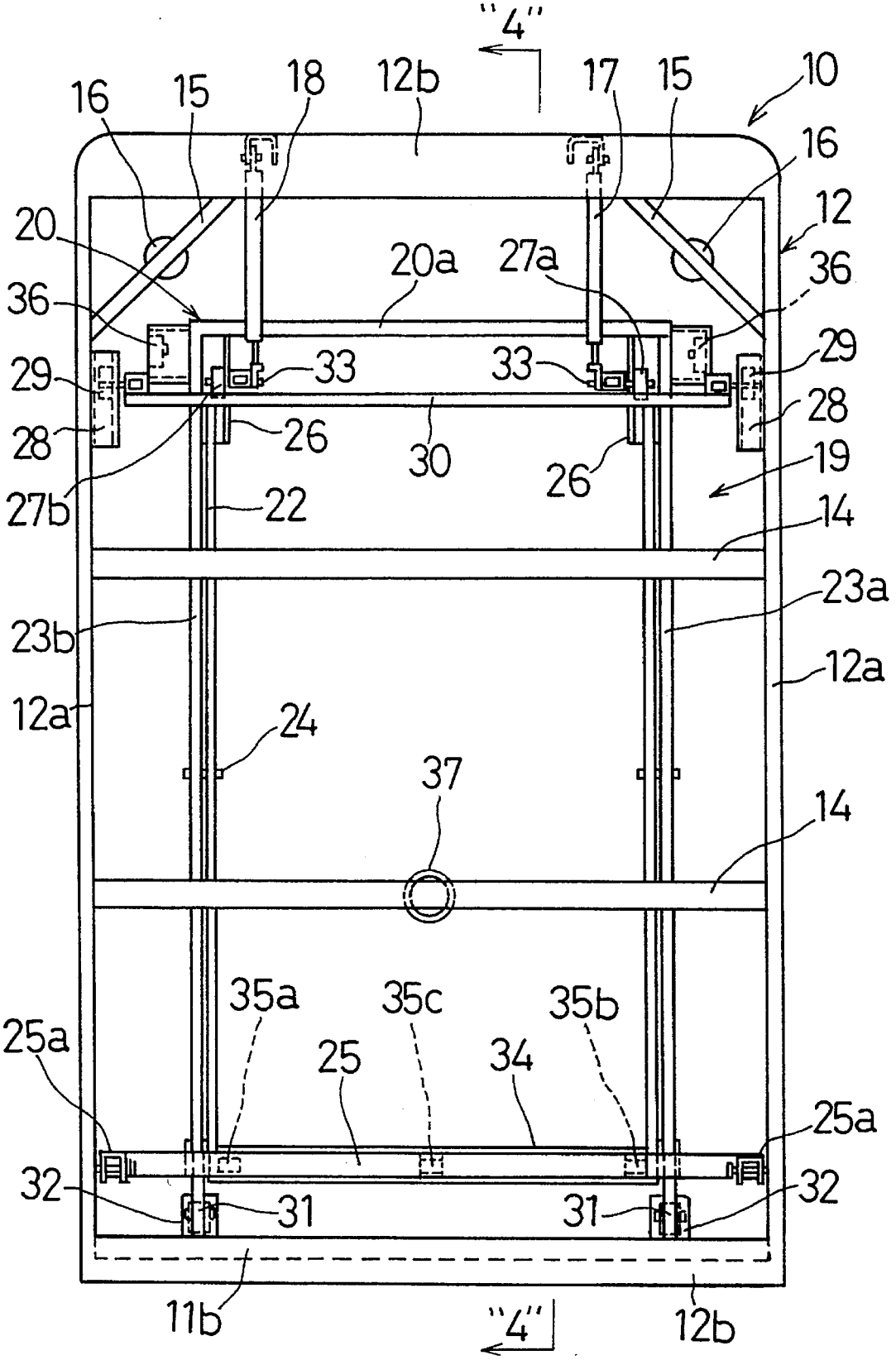
FIG. 5 is a drawing viewed from above for illustrating a bed body of a Second Preferred Embodiment of a bed according to the present invention.

The Second Preferred Embodiment of a bed according to the present invention will be hereinafter described with reference to FIGS. 4 through 7. A bed body 10 is comprised of a rectangle-shaped bottom frame 11, a floor frame 12 of the same shape, and a plurality of supporting pillars 13 disposed between the bottom frame 10 and the floor frame 12. As illustrated in FIG. 5, the floor frame 12 is comprised of floor-side longer frames 12*a*, 12*a* disposed in the longitudinal direction (hereinafter referred to as the "forward and rearward direction"), and floor-side shorter frames 12*b*, 12*b* disposed in the lateral direction perpendicularly with the floor-side longer frames 12*a*, 12*a*. Likewise, the bottom frame 11 is comprised of bottom-side longer frames 11*a*, 11*a* and floor-side shorter frames 11*b*, 11*b*. The floor frame 12 is provided with a plurality of floor bars 14 connecting between the opposing floor-side longer frames 12*a*, 12*a*. Similarly, the bottom frame 11 is provided with a plurality of bottom bars (not shown) connecting between the opposing bottom-side longer frames 11*a*, 11*a*. Further, the bottom frame 11 is provided with four oblique bars 15 at the four corners where the bottom-side longer bar 11*a* and the bottom-side shorter bar 11*b* cross each other. The oblique bars 15 bridge between the bottom-side longer bar 11*a* and the bottom-side shorter bar 11*b*. Furthermore, each of the oblique bars 15 is equipped with a main leg 16.

The Second Preferred Embodiment of the present bed is provided with ascending and descending means for ascending and descending the bed body 10 and a mattress 60 as a whole. As illustrated in FIGS. 4 and 5, the ascending and descending means is comprised of two extensible and retractable actuators 17, 18, and an ascending and descending link 19 operated by the extensible and retractable actuators 17, 18. The extensible and retractable actuators 17, 18 are disposed, for example, on the right side of the bed body 10 in FIG. 4, and they are provided with a gas spring therein.

As can be appreciated from FIG. 5, the ascending and descending link 19 is comprised of a pair of parallel elements, and a pair of rotary elements which are disposed respectively on the left and right sides and which are put into a crossing relationship. In the Second Preferred Embodiment, for instance, one of the parallel elements is the floor frame 12, and the other one of the parallel elements is a rectangle-shaped auxiliary leg member 20 having a laterally-traversing bar 20*a*. Turning now to FIG. 4, the auxiliary leg 20 is equipped with a pair of first spacers 21, 21 which are disposed projectingly on the left and right forward-sides, respectively, (e.g., on the left bottom-side in FIG. 4). As illustrated in FIG. 5, the rotary elements are comprised of inner-side rotary members 22, 22 which constitute a supporting member and which are disposed respectively on the left and right inner-sides, and outer-side rotary members 23*b*, 23*a* which are disposed respectively on the left and right outer-sides. The inner-side rotary members 22, 22, and the outer-side rotary members 23*a*, 23*b* can be rotated about fulcrum members 24, 24. Further, the ascending and descending link 19 is provided with a lateral member 34 which inhibits the outer-side rotary members 23*a*, 23*b* from warping in their thickness-wise direction. The lateral member 34 is equipped with second spacers 35*a*, 35*b* which are disposed at the opposite ends, and another second spacer 35*c* which has a height larger than that of the second spacers 35*a*, 35*b* at least and which is disposed in the middle of the lateral member 34. The second spacers 35*a*, 35*b*, 35*c* are preferably formed of a resilient substance.

Figure 7:
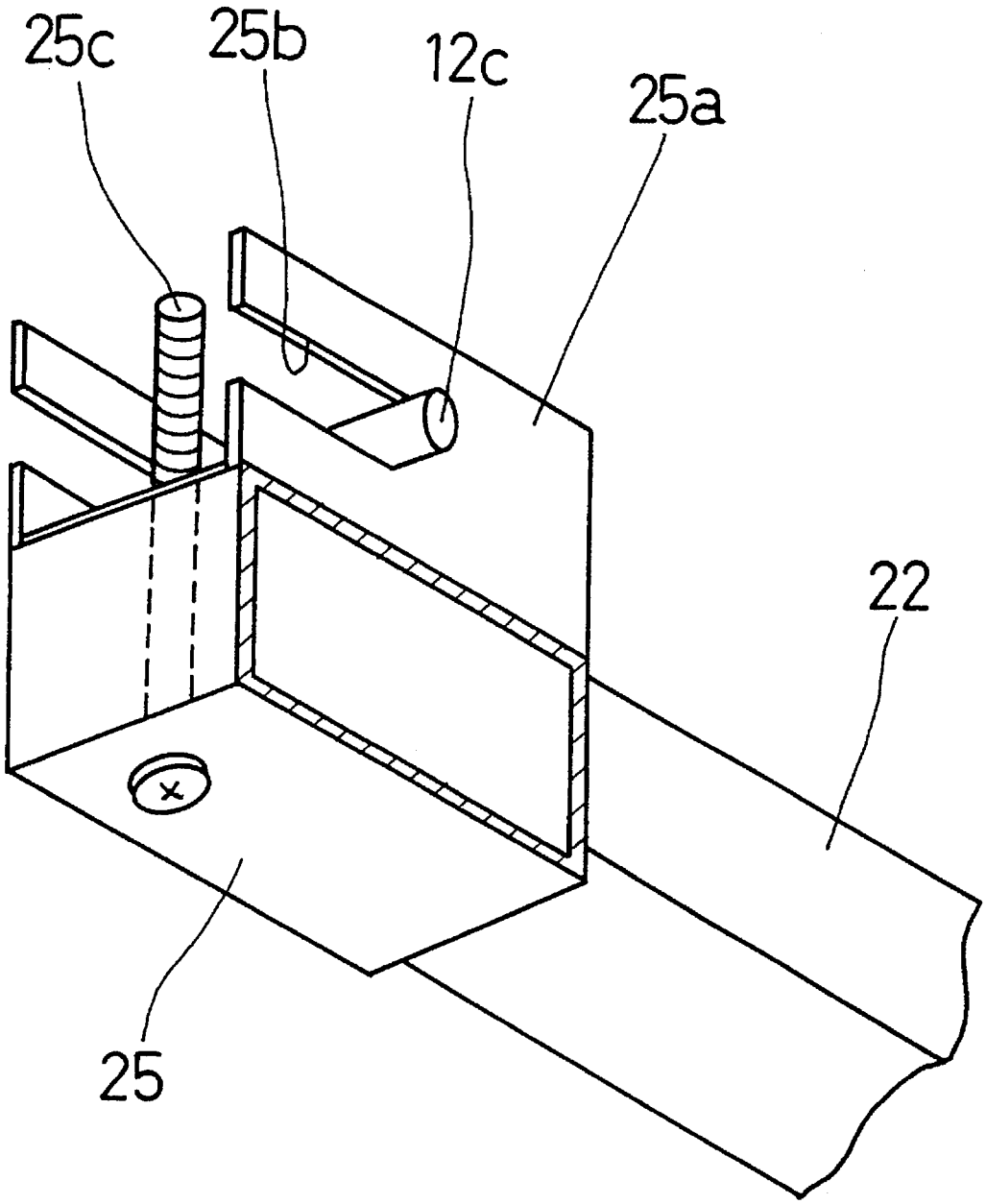
FIG. 7 is an enlarged drawing for illustrating a fulcrum member of the Second Preferred Embodiment.

As can be understood from FIG. 5, at an upper end of the inner-side rotary members 22, 22, the inner-side rotary members 22, 22 are rotatably supported by an upper forward-side rotary bar 25 via fulcrum members 25*a*, 25*a*, respectively. The upper forward-side rotary bar 25 bridges between the floor-side longer frames 12*a*, 12*a*. At a lower end of the inner-side rotary members 22, 22, the inner-side rotary members 22, 22 are rotatably supported by a rotary shaft of rollers 27*a*, 27*b*, respectively. The rollers 27*a*, 27*b* can rotate on inner-side rails 26, 26 which are installed on the auxiliary leg member 20 and which constitute a supporting member. Further, the upper forward-side rotary bar 25 is brought into contact with the second spacers 35*a*, 35*b*, 35*c* so as to support the weight of the bed body 10 by the floor via the second spacers 35*a*, 35*b*, 35*c* and the outer-side rotary members 23*a*, 23*b*, thereby constituting a main leg member. As illustrated in FIG. 7, the fulcrum member 25*a* is provided with a slot 25*b* into which a pin 12*c* is fitted. The pin 12*c* is disposed on the floor-side longer frame 12*a*, and it is prevented from coming off the slot 25*b* by a screw 25*c*.

As can be seen from FIG. 4, at an upper end of the outer-side rotary members 23*a*, 23*b*, the outer-side rotary members 23*a*, 23*b* are rotatably supported by rollers 29, 29, respectively, via an upper rearward-side rotary bar 30. The rollers 29, 29 can rotate respectively on outer-side rails 28, 28 which are installed to the floor-side longer frames 12*a*, 12*a*. At a lower end of the outer-side rotary members 23*a*, 23*b*, the outer-side rotary members 23*a*, 23*b* are supported respectively by fulcrum members 31*a*, 31*a* which are installed to the auxiliary leg member 20. As illustrated in FIGS. 4 and 5, first projecting ends 31, 31 are disposed on the fulcrum members 31*a*, 31*a* so as to further extend therefrom, and they are equipped with a caster 32 which is held rotatably about a supporting shaft.

As illustrated in FIG. 5, the extensible and retractable actuators 17, 18 are supported rotatably by the floor-side shorter frame 12*b* at the base end. They are supported rotatably by rollers 27*a*, 27*b* via fulcrum members 33, 33 at the working end, and finally they are supported by an inner-side rail 26, constituting a supporting member therefor, via these rollers 27*a*, 27*b*. Here, a gas spring having a free piston is used for the extensible and retractable actuators 17, 18. It is naturally possible to use a gas piston having a locking mechanism therefor.

Further, on the right side of the auxiliary leg member 20 in FIG. 4, there is installed a pair of casters 36, 36 (as illustrated in FIG. 5) which can be fixed to a supporting shaft.

Furthermore, as can be understood from FIGS. 4 and 5, between the floor bar 14 and the auxiliary leg member 20, there is disposed a spring 37 which helps the extending and retracting operations of the extensible and retractable actuators 17, 18 at their start-up.

The operations of the Second Preferred Embodiment of the present bed thus constructed will be hereinafter described. First of all, when the present bed is in the ordinary service position, the bed body 10 is placed at the lowermost position as illustrated in FIG. 4. At this moment, the extensible and retractable actuators 17, 18 are contracted by the gravity of the bed body 10.

Figure 6:
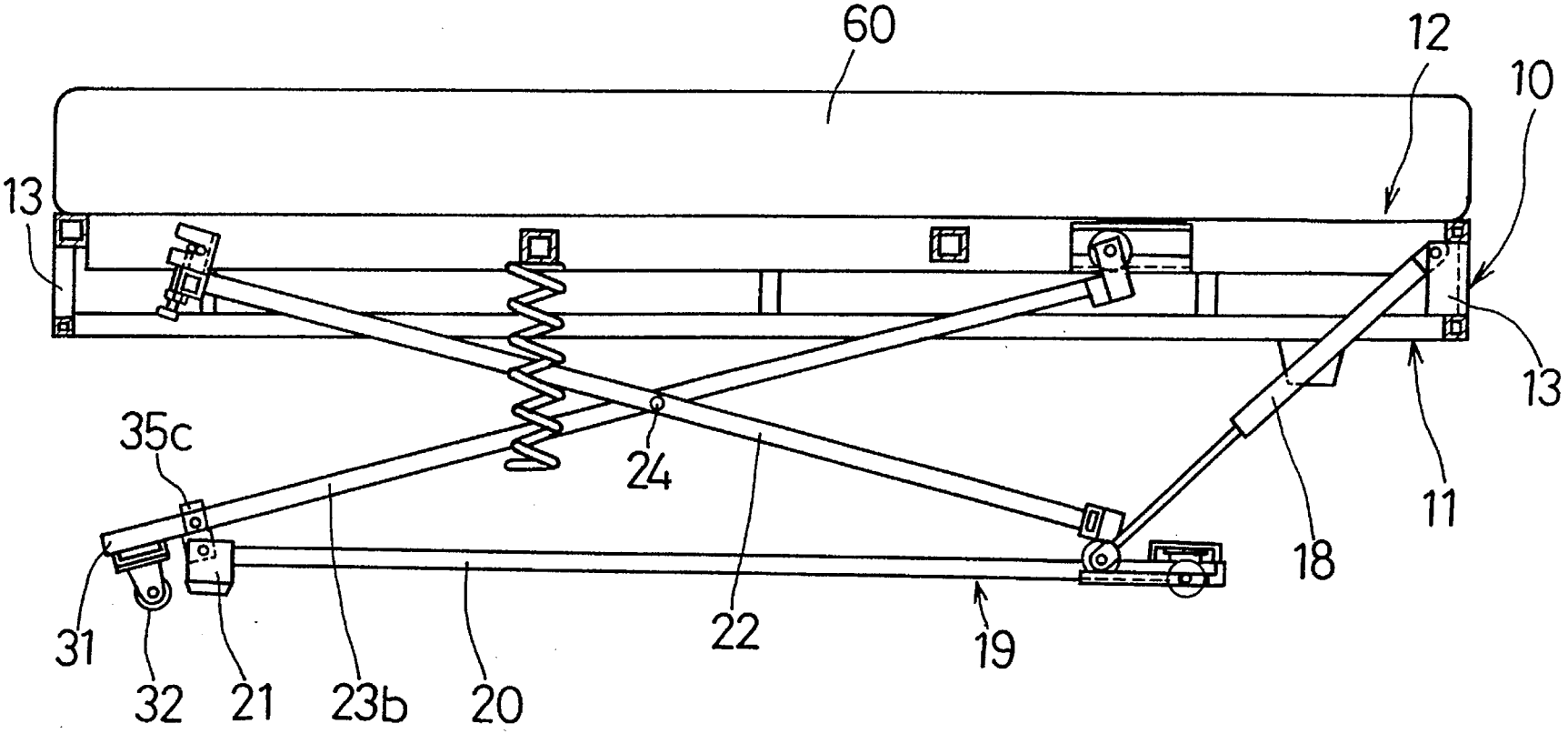
FIG. 6 is a drawing for illustrating the bed body of the Second Preferred Embodiment at an uppermost position.

When ascending the bed body 10, the bed body 10 is slightly pushed up manually at the right side thereof in FIG. 4. Thus, the extensible and retractable actuators 17, 18 are now subjected to the thus decreased external force, and accordingly they start extending. When the actuators 17, 18 start extending, the spring 37 further reduces the external force applied to the actuators 17, 18, and consequently, due to its elastic force, the extending force of the actuators 17, 18 is increased. As a result, the rollers 27*a*, 27*b* and the rollers 29, 29 are rotated on the rails 26, 26 and on the rails 28, 28, respectively. At the same time, the rotary members 22, 22, 23*a*, 23*b* of the ascending and descending link 19 rotate so as to increase the angles between them and the floor frame 12 and the angles between them and the auxiliary leg member 20 as illustrated in FIG. 6. Finally, the bed body 10 is ascended to an uppermost position which is determined by the extensible and retractable actuators 17, 18 and the spring 37. When a gas piston having a locking mechanism is used for the actuators 17, 18, it is possible to hold the bed body 10 at desired heights.

When putting the bed body 10 back to the ordinary service position, it is necessary to simply press down the bed body 10.

Since the Second Preferred Embodiment of the present bed is provided with the first spacer 21, the space can be reduced between the inner-side rotary members 22, 22 and the outer-side rotary members 23*a*, 23*b* on the right side in FIG. 4. Accordingly, the main legs 16 can be grounded completely. If one tries to reduce the space between the inner-side rotary members 22, 22 and the outer-side rotary members 23*a*, 23*b* on the left side in FIG. 4 by using certain means, the bed body 10 inclines. However, the first spacer 21 can inhibit the bed body 10 from inclining. Further, since the Second Preferred Embodiment is equipped with the second spacers 35*a*, 35*b*, 35*c* which are installed to the lateral member 34, the bed body 10 is supported at three points, for example, the main legs 16, 16 installed thereto and the middle second spacer 35*c*. Consequently, the portions constituting the main leg member of the present bed can be grounded further completely.

Third Preferred Embodiment

The Third Preferred Embodiment of a bed according to the present invention will be hereinafter described with reference to FIGS. 8 through 10, and its arrangements which differ from those of the Second Preferred Embodiment are set forth below.

Figure 8:
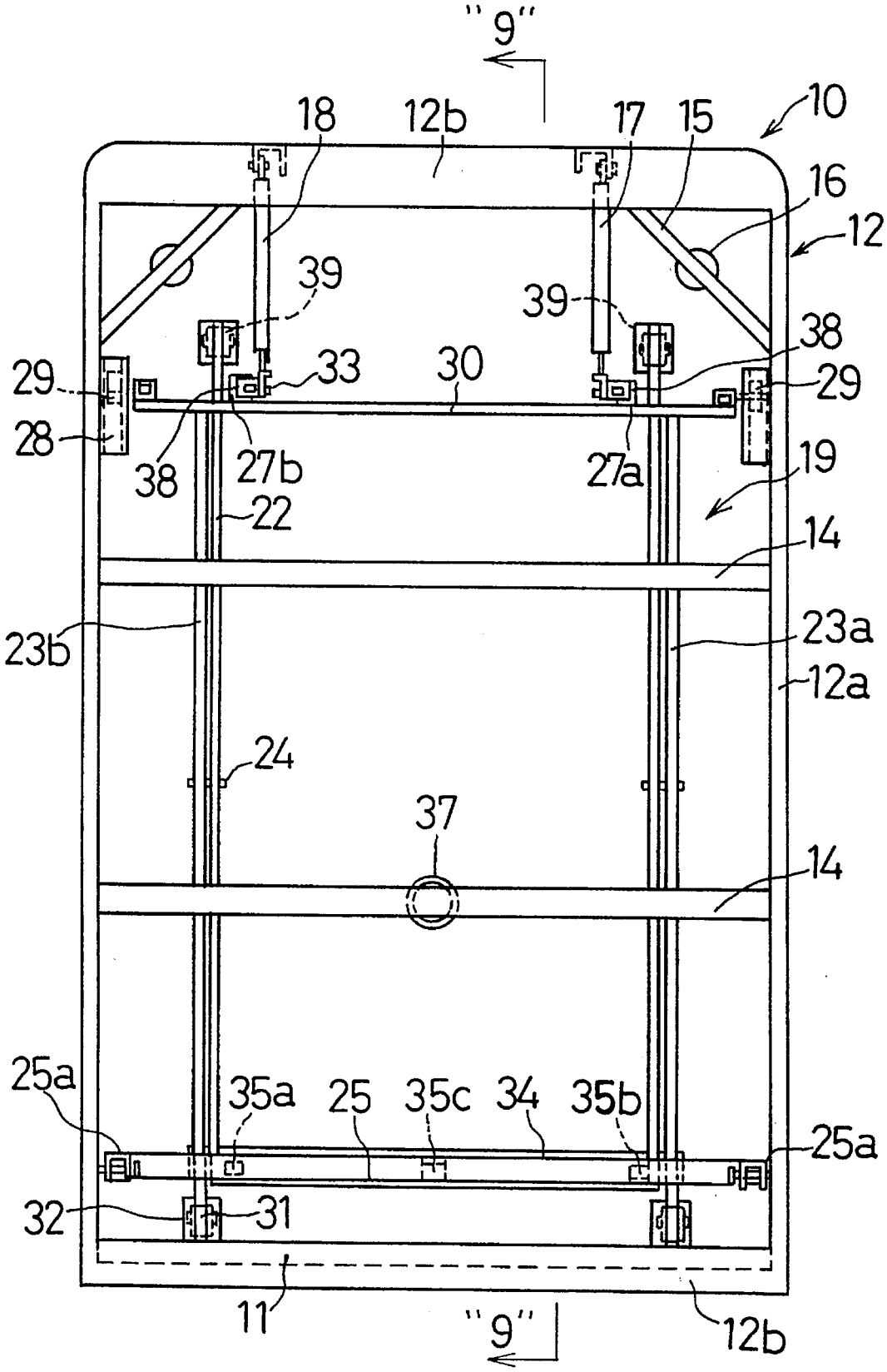
FIG. 8 is a drawing viewed from above for illustrating a bed body of a Third Preferred Embodiment of a bed according to the present invention.

As illustrated in FIG. 8, in the Third Preferred Embodiment, the extensible and retractable actuators 17, 18 are supported rotatably by the rollers 27*a*, 27*b* at the working end in a manner similar to those of the Second Preferred Embodiment. The rollers 27*a*, 27*b* constitute a supporting member, and they are supported by fixing members 38, 38 (best shown in FIG. 9) whose height is adjusted so as to ground together with the legs 16 when the bed body 10 is placed at the lowermost position as illustrated in FIG. 9. Further, as best shown in FIG. 9, at the lower end of the inner-side rotary members 22, 22, there is disposed a second projection end 40 to which a caster 39, held rotatably about a supporting shaft, is installed.

Figure 9:
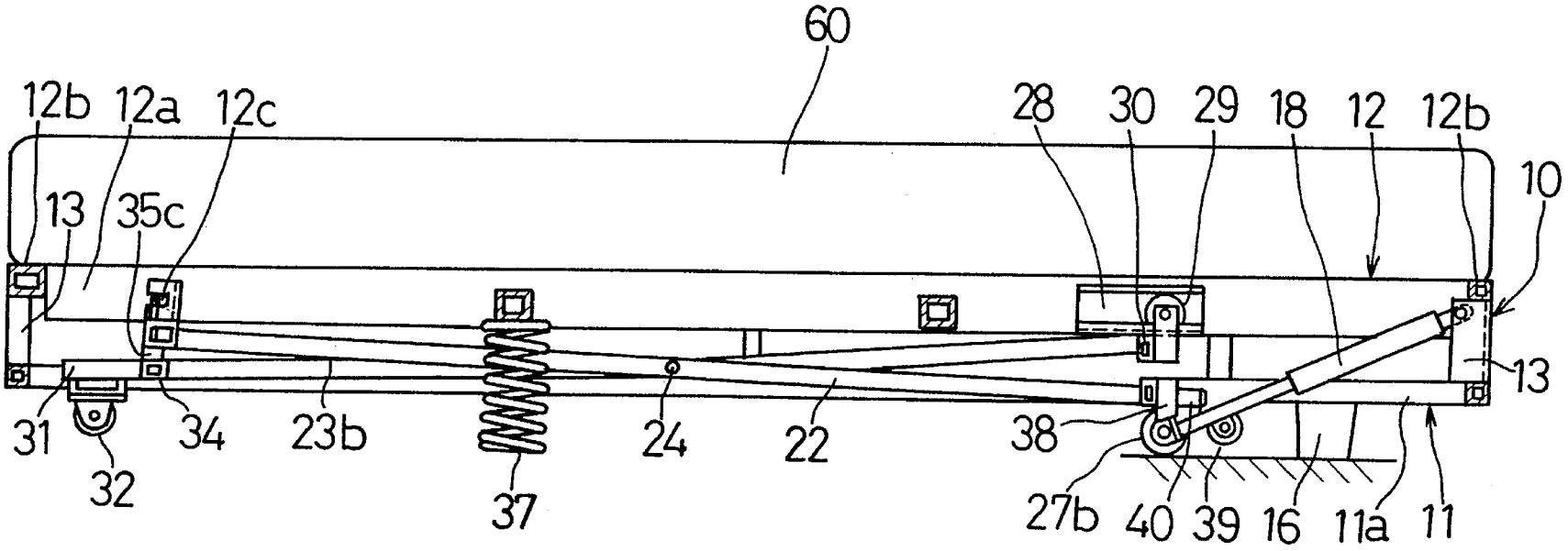
FIG. 9 is a cross-sectional view which is taken along the lines "9"—"9" of FIG. 8.

In the Third Preferred Embodiment, when ascending the bed body 10, the bed body 10 is slightly pushed up manually at the right side thereof in FIG. 9. Thus, the extensible and retractable actuators 17, 18 are now subjected to the thus decreased external force, and accordingly they start extending. When the actuators 17, 18 start extending, the rollers 27*a*, 27*b* are rotated, and the rotary members 22, 22, 23*a*, 23*b* of the ascending and descending link 19 are rotated so as to increase the angles between them and the floor frame 12 as illustrated in FIG. 10. Finally, the bed body 10 is ascended. Simultaneously therewith, the rollers 27*a*, 27*b* are taken off the ground, and at the same time the casters 39, 39, held rotatably about a supporting shaft, are grounded.

The Third Preferred Embodiment is thus constructed so that the auxiliary leg member 20 of the Second Preferred Embodiment can be obviated. As a result, it can be manufactured at a less expensive manufacturing cost.

Fourth Preferred Embodiment

The Fourth Preferred Embodiment of a bed according to the present invention will be hereinafter described with reference to FIGS. 11 through 14, and its arrangements which differ from those of the Second Preferred Embodiment are set forth below.

Figure 11:
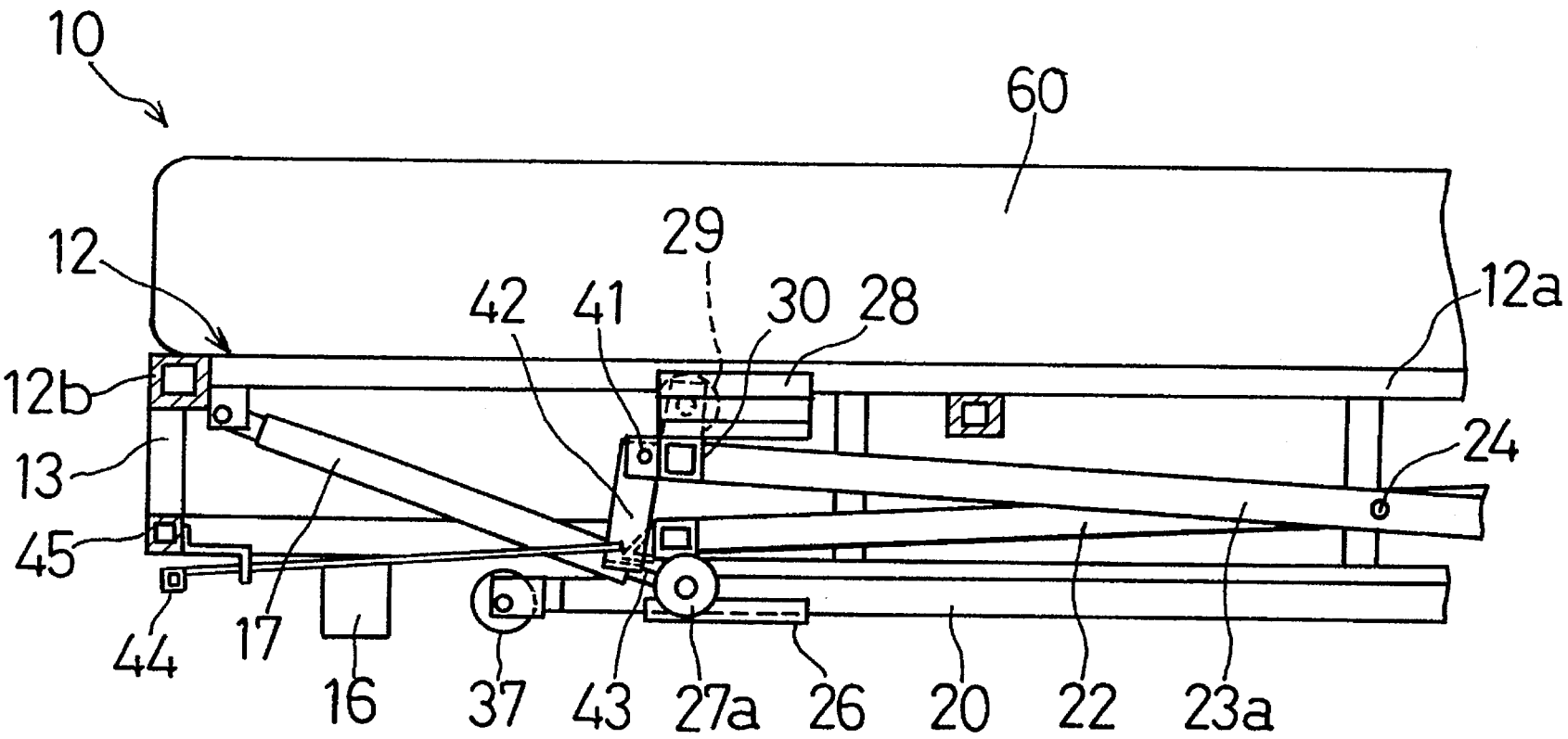
FIG. 11 is a side view of a bed body of a Fourth Preferred Embodiment of a bed according to the present invention.
Figure 12:
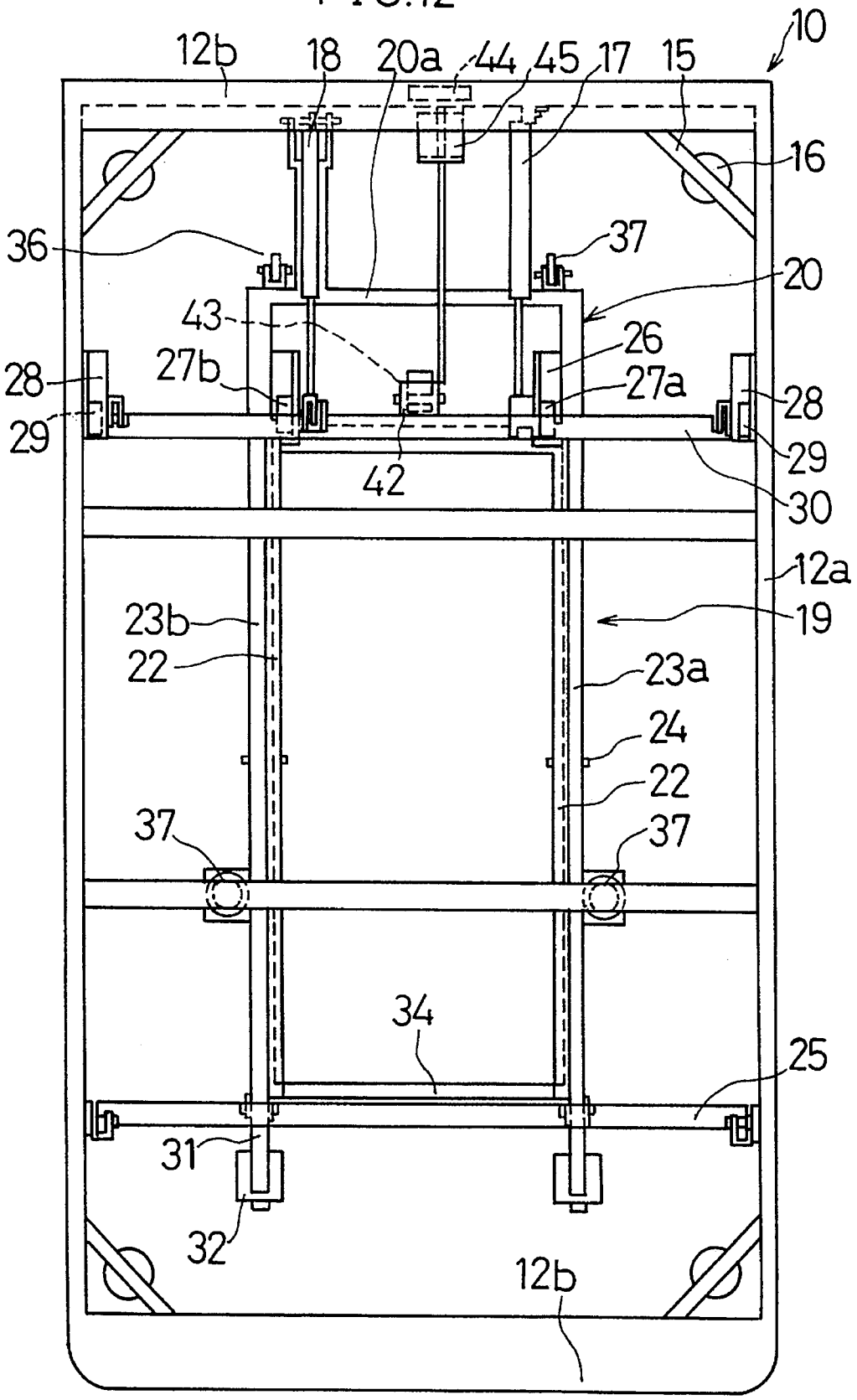
FIG. 12 is a drawing viewed from above for illustrating the bed body of the Fourth Preferred Embodiment.
Figure 13:
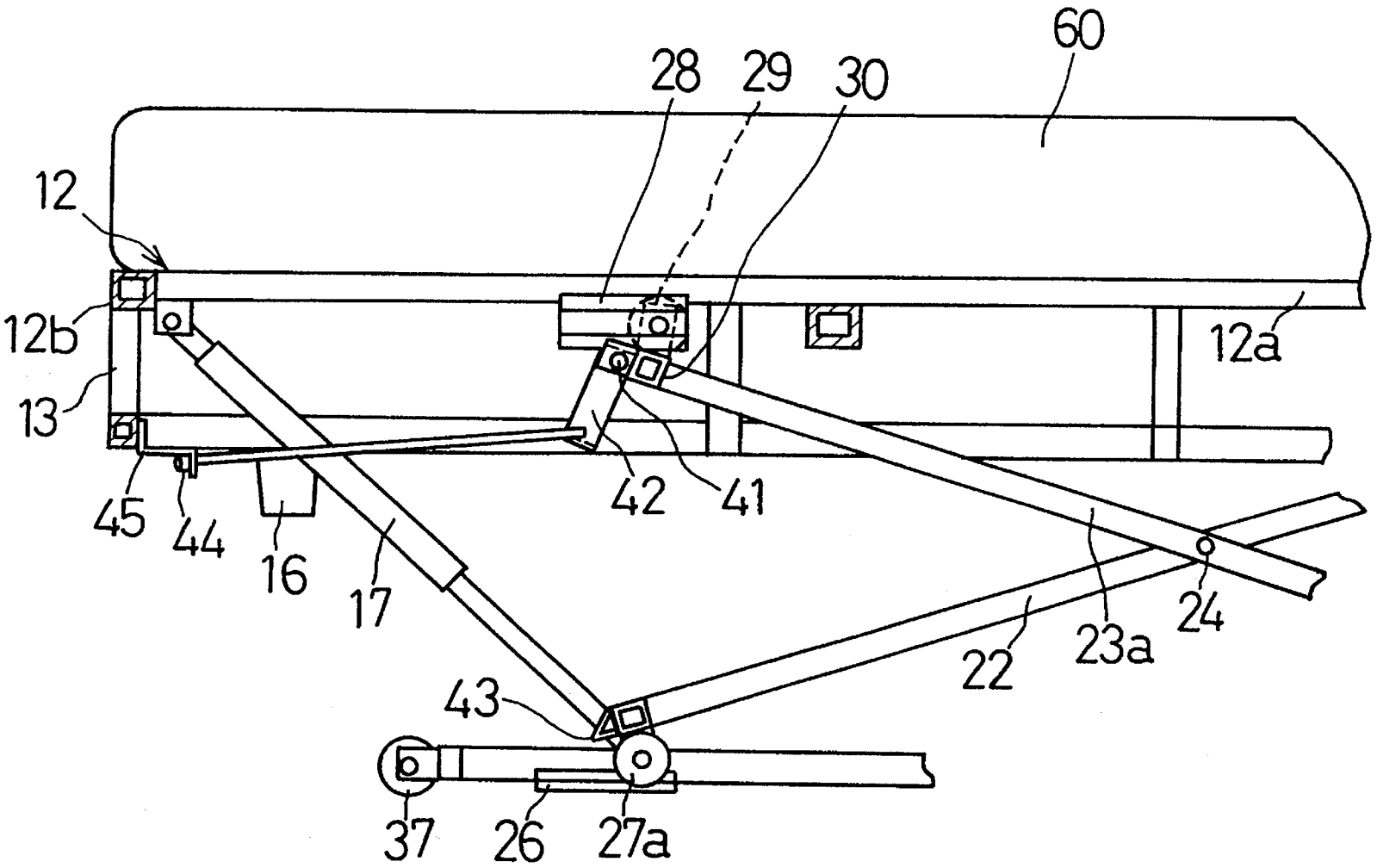
FIG. 13 is a drawing for illustrating the bed body of the Fourth Preferred Embodiment at an uppermost position.
Figure 14:
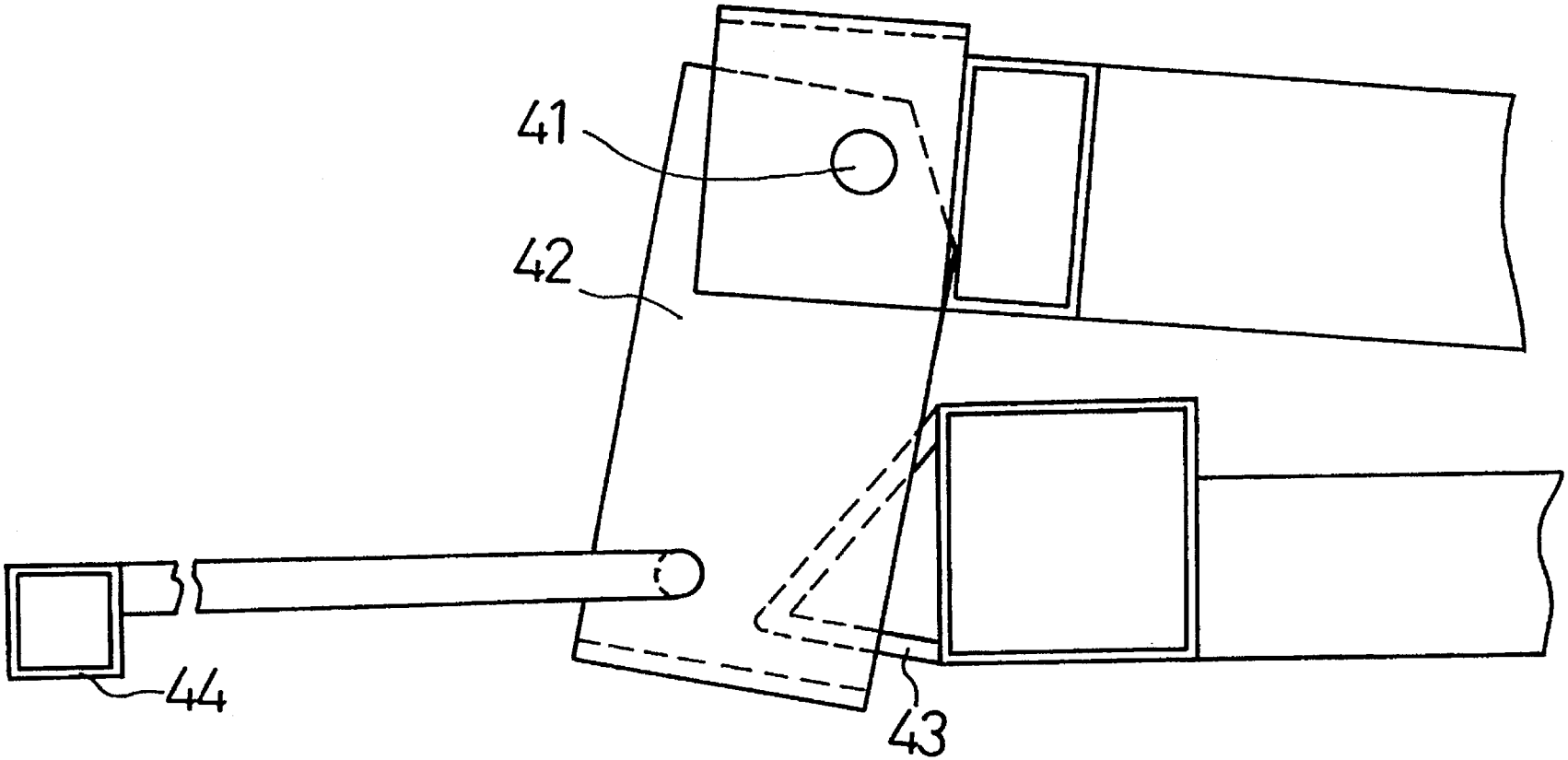
FIG. 14 is an enlarged drawing for illustrating locking means of the Fourth Preferred Embodiment.

The Fourth Preferred Embodiment is provided with locking means for locking the operations of the ascending and descending link 19. As illustrated in FIG. 11, the locking means is placed at the left end of the outer-side rotary member 23*a* and the inner-side rotary member 22 in the drawing. At the left end of the outer-side rotary member 23*a* in FIG. 11, there is disposed an engager member 42 which is held eccentrically rotatably about a pin 41. At the left end of the inner-side rotary member 22 in FIG. 11, there is disposed an engagee member 43 with which the engager member 42 engages. As best shown in FIG. 14, the engagee member 43 is formed in a triangle in cross-section.

As illustrated in FIG. 11, a releasing lever 44 is further installed to the engager member 42 at one of its ends, and it is supported by a holder 45 at the other one of the ends. The holder 45 is installed to the floor-side shorter frame 12*b*.

In the Fourth Preferred Embodiment, the urging force of the extensible and retractable actuators 17, 18 is designed to be larger than the weight of the bed body 10. Accordingly, when bed-making personnel disengages the engager member 42 from the engagee member 43, the bed body 10 is ascended to the uppermost position (shown in FIG. 13) by the urging force of the extensible and retractable actuators 17, 18. When the bed body 10 is pressed downward in order to put it back to the ordinary service position, the bed body 10 is descended, and simultaneously the engager member 42 is slid on the inclined surface of the engagee member 43 formed in a triangle in cross-section. Thus, the engager member 42 and the engagee member 43 are locked to each other automatically.

Further, the Fourth Preferred Embodiment is equipped with the locking means. Consequently, the extensible and retractable actuators 17, 18 can operate the ascending and descending link 19 with a force greater than the weight of the bed body 10. As result, the force required for a bed-making personnel for ascending the bed body 10 can be reduced, and the present bed can be also improved in terms of the stability when the bed body 10 is put into the descended state.

Furthermore, in the Fourth Preferred Embodiment, the locking means is provided with the releasing lever 44 which is disposed under the bed body 10. Thus, it is possible to allow only bed-making personnel to know of the existence of the releasing lever 44 to easily release the locking means.

Moreover, also in the above-described Second, Third and Fourth Preferred Embodiments, the bed body 10 is ascended together with the mattress 60. Therefore, bed-making personnel can easily determine whether the mattress 60 is displaced on the bed body 10 or not. Since the extensible and retractable actuators 17, 18 are equipped with the supporting member which is formed in the identical construction, it is possible to apply the same load to them. Hence, the present bed can be inhibited from inclining, and the main leg member including the main legs 16 can be grounded completely.

Figure 10:
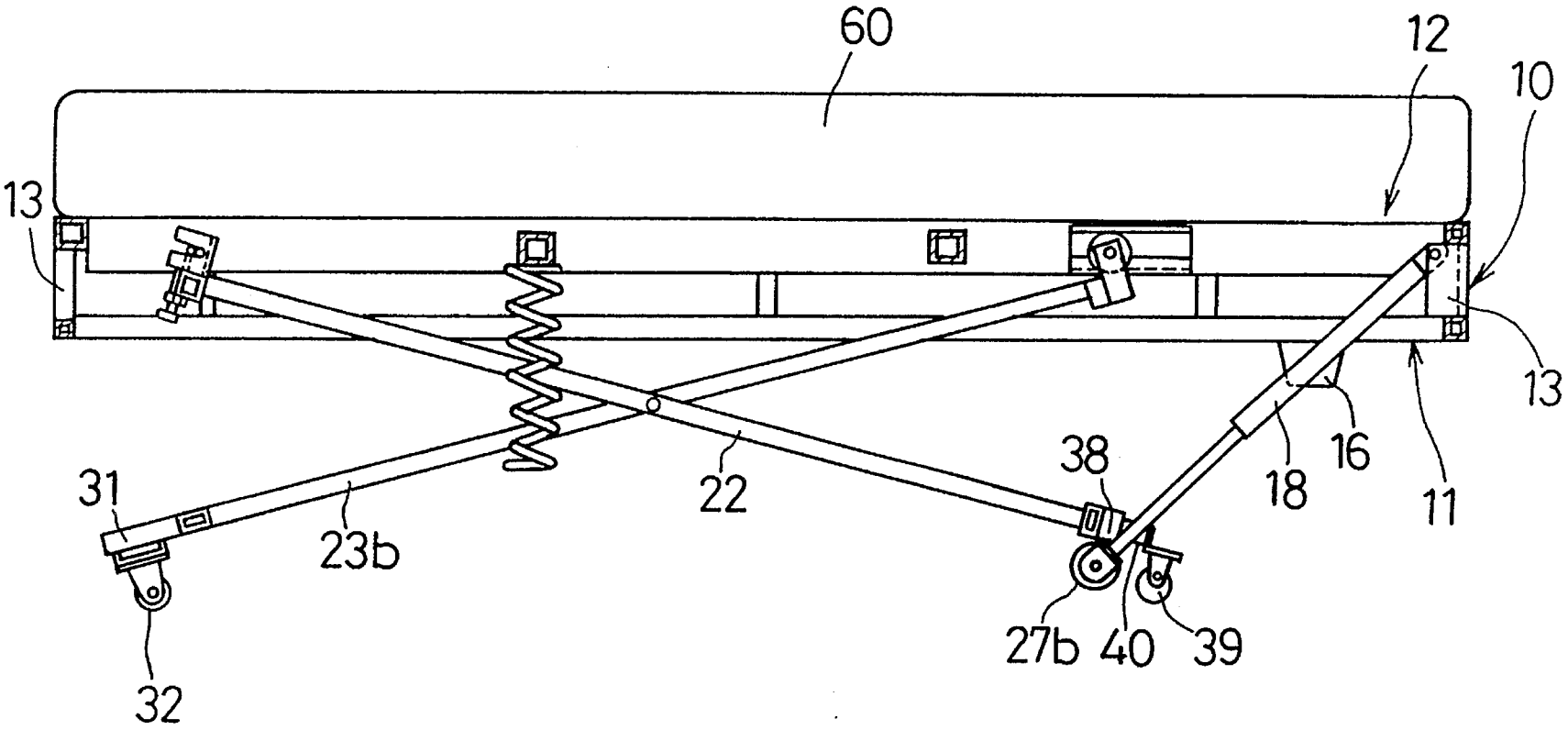
FIG. 10 is a drawing for illustrating the bed body of the Third Preferred Embodiment at an uppermost position.

In addition, in the Second Preferred Embodiment, when ascending the bed body 10, the bed body 10 is operated at the right side in FIG. 4 (in the case of the Third and Fourth Preferred Embodiments, at the left side in FIGS. 10 and 11, respectively). During the operation, bed-making personnel are inhibited from interfering with the supporting member at his or her legs.

Having now fully described the present invention, it will be apparent to one of ordinary skill in the art that many changes and modifications can be made thereto without departing from the spirit or scope of the present invention as set forth herein including the appended claims.

What is claimed is:

1. A bed comprising:

a bed body including a frame and a main leg member fixed to one of longitudinal opposite sides of said frame;

a pair of rotary members having opposite ends, one of said rotary members held rotatably to one of longitudinal opposite sides of said bed body at one of the opposite ends, the other one of said rotary members held slidably and rotatably to the other longitudinal opposite sides of said bed body at one of opposite ends;

a fulcrum member supporting said rotary members relatively rotatably at a middle of said rotary members; and a pair of casters held to said other ends of said rotary members.

2. The bed according to claim 1, wherein said casters which are close to said main leg member are held swingably to said other ends of some of said rotary members, and the other casters which are far from said main leg member are fixed to said other ends of the rest of said rotary members.

3. The bed according to claim 1, wherein an extensible and retractable actuator which rotates said rotary members for ascending and descending said body is provided.

4. The bed according to claim 3, wherein said extensible and retractable actuator is provided between said bed body and one of said rotary members.

5. The bed according to claim 4, wherein a caster is disposed at the tip of said extensible and retractable actuator.

* * * * *